United States Patent [19]

Miller et al.

[11] Patent Number: 4,474,028

[45] Date of Patent: Oct. 2, 1984

[54] SOLAR POWERED REFRIGERATION UNIT

[75] Inventors: Albert J. Miller, Campbell; Robert Kortzeborn, Palo Alto, both of Calif.

[73] Assignee: Helio-Therm, Ltd., Los Gatos, Calif.

[21] Appl. No.: 508,343

[22] Filed: Jun. 27, 1983

[51] Int. Cl.[3] ..... F25B 27/00; H01L 31/00; F25D 23/12

[52] U.S. Cl. ..... 62/235.1; 136/245; 136/291; 136/293; 320/2; 62/236

[58] Field of Search ..... 136/245, 291, 293; 62/235.1, 236; 320/2

[56] References Cited

U.S. PATENT DOCUMENTS 3,921,049 11/1975 Mellors et al. ..... 320/2

4,367,633 1/1983 Strathman ..... 62/236

FOREIGN PATENT DOCUMENTS 3010571 9/1981 Fed. Rep. of Germany ..... 136/245

*Primary Examiner*—Aaron Weisstuch

*Attorney, Agent, or Firm*—Harris Zimmerman; Howard Cohen

[57] ABSTRACT

A solar powered refrigeration unit includes an array of solar cells connected in series-parallel configuration to produce more than 12 volts dc. One side of the array is grounded, and the positive output is connected through a diode to the positive terminal of a storage battery. The diode is configured to prevent the battery discharging through the solar cell array. The array is also connectd to one side of a back to back diode arrangement, the junction of which is connected through a thermocouple to a voltage controlled relay. The refrigeration unit compressor is connected to the relay, which is switched on by the thermocouple. The back to back diode arrangement permits the greater voltage of the solar cell array or the storage battery to power the compressor.

1 Claim, 4 Drawing Figures

SOLAR POWERED REFRIGERATION UNIT

BACKGROUND OF THE INVENTION

The following United States Patents comprise the closest known prior art: U.S. Pat. Nos. 2,297,761, 2,692,483, 2,202,019, 3,943,726, 4,028,904.

A growing number of people can attest to the increase in recreational time available to many, and the new products designed to make our lives more enjoyable. Entire industries have been created to fill the nationwide desire for products to aid us in spending leisure and vacation time. The recreational vehicle industry is just one example of the industry response to a nationwide trend.

A continual problem associated with the recreational industry is that of making life as convenient and comfortable as possible is remote recreational areas where there is limited or no convenient form of electrical power. Family vacationers face the problem of keeping food cool enough to preserve it over a prolonged period of time. In a recreational vehicle or boat, a refrigeration unit must be powered by a storage battery or by compressed gas. When the vehicle or boat engine is operating, the storage battery is constantly recharged. However, when the vehicle is not operating, the refrigeration unit drains the storage battery and may prevent restarting of the vehicle engine. Furthermore, seriously depleting the charge in a storage battery may damage or destroy the battery. It is clearly not cost effective to operate the vehicle engine merely to maintain a charge in the storage battery.

An obvious source of untapped energy which could be used to operate refrigerators is the heat of the sun. This is especially true when considering the fact that many recreational areas are blessed with an inordinately large amount of insolation. Indeed, this is a prime requisite for a recreation area.

Furthermore, aside from recreational uses, the amount of energy consumed in refrigeration of perishable goods is enormous. In the state of California, the amount of electricity used in refrigeration is equal to the output of two large nuclear reactors. Throughout the United States, the amount of electricity used in refrigeration is equal to the output of approximately twenty nuclear power plants. Clearly, the use of solar power to power refrigerators could save a vast amount of nonrenewable energy sources, without releasing any pollutants nor contaminating the biosphere with radiation.

SUMMARY OF THE PRESENT INVENTION

The present invention generally comprises an apparatus for driving a refrigeration unit using the radiant energy of the sun. The apparatus permits the use of refrigeration in areas remote from convenient electrical supplies, and is particularly adapted to use in recreational vehicles and boats. However, the apparatus may be used in any area where the insolation is sufficient to make the use cost effective.

The solar powered refrigeration unit includes an array of solar cells connected in series-parallel configuration to produce more than 12 volts dc. One side of the array is grounded, and the positive output is connected through a diode to the positive terminal of a storage battery. The diode is configured to prevent the battery discharging through the solar cell array. The array is also connected to one side of a back to back diode arrangement, the junction of which is connected through a thermocouple to a voltage controlled relay. The refrigeration unit compressor is connected to the relay, which is switched on by the thermocouple. The back to back diode arrangement permits the greater voltage of the solar cell array or the storage battery to power the compressor.

DESCRIPTION OF THE PRESENT INVENTION

Figure 1:
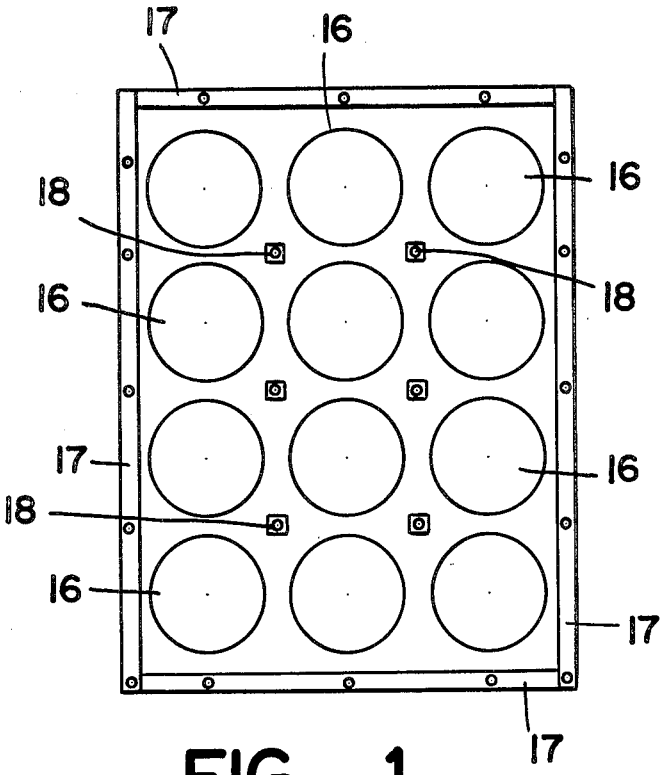
FIG. 1 is a plan view of a solar panel of the present invention.
Figure 2:
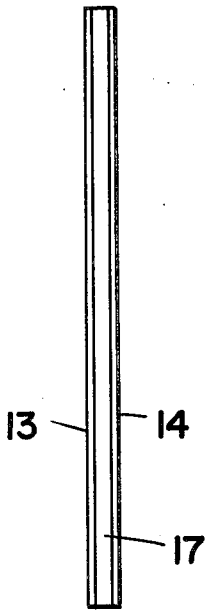
FIG. 2 is a side view of the solar panel depicted in FIG. 1.
Figure 3:
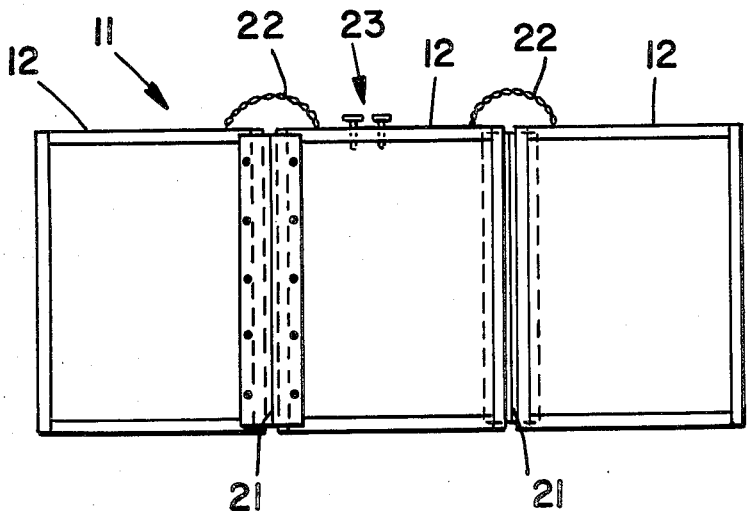
FIG. 3 is a plan view of the entire solar panel assembly of the present invention.

The present invention generally comprises a solar powered refrigeration unit for use in areas where standard electrical supplies are not available, or wherever is it cost effective to be used. With reference to FIGS. 1–3, the invention includes a solar panel assembly 11 comprised of a trio of solar panels 12. Each of the three solar panels 12 includes a transparent outer panel 13 formed of plastic or the like, and a rigid base panel 14 disposed directly adjacent thereto. A plurality of silicon solar cells 16 are mounted on the base panel 14, and are sandwiched between the base panel and the outer panel. In the preferred embodiment each panel 12 is provided with twelve solar cells in a 3×4 array. An outer edge moulding 17 maintains the assembly of each solar panel 12. A plurality of stub posts 18 extend from the base panel toward the outer panel to support any compressive forces therebetween which might tend to bend the panel 12 and fracture the panel 13 or the solar cells 16.

The three solar panels 12 are joined edge to edge by a pair of front surface piano hinges 21 to form an assembly which is easily folded for storage and transport. A pair of interconnect cables extend between adjacent panels 12 to join electrically the solar cells thereof. In the preferred embodiment the cells are connected in two parallel arrays of eighteen cells in series. This configuration results in an output of approximately 15 volts dc at 8 amps. The combined output of the solar panels is conducted to a connector 23 extending from the medial panel of the assembly.

It may be appreciated that the refrigeration unit of the present invention may comprise any standard enclosure which is insulated and closable. Furthermore, the refrigeration unit includes a standard motor-driven compressor and evaporator coil arrangement, as is well known in the prior art.

Figure 4:
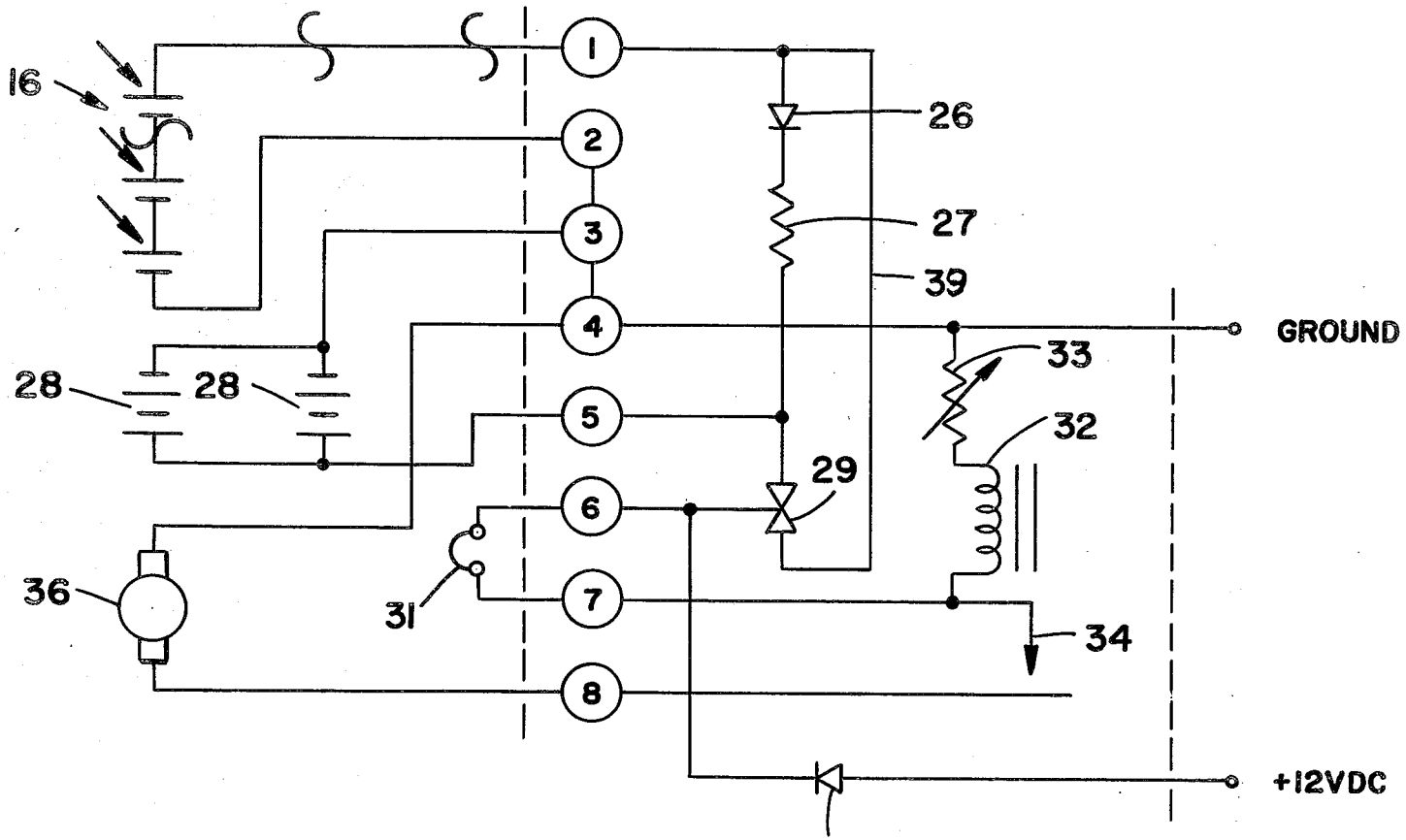
FIG. 4 is a schematic representation of the electrical circuitry of the present invention.

With regard to FIG. 4, the positive output of the solar cells 16 is connected through terminal 1 to a forward bias diode 26. The diode 26 is connected through a current limiting resistor 27 to terminal 5, and thence to the positive terminal of a storage battery 28. The negative output of the solar cells 16 is connected through terminals 2,3, and 4 to a ground line. The negative side of the battery 28 is also connected to terminal 3, and thus to ground. The current limiting resistor 27 is also connected to a pair of back to back diodes 29, the other side of which is connected back to terminal 1 and thus to the positive side of the solar cell array.

The junction of the back to back diodes 29 is connected through terminal 6 to a thermocouple 31 which is disposed to sense the temperature within the refrigeration enclosure. The other side of the thermocouple is connected through terminal 7 to a voltage controlled relay 32. The relay 32 is in series with a variable resistor 33, which in turn is connected to ground. The switched contact of the relay is connected through terminal 8 to the motor 36 of a motor driven refrigeration compressor. The other side of the motor 36 is connected through terminal 4 to ground. An external power source (12 VDC) may be connected to a diode 37 which is connected in turn to terminal 6, so that current may flow either to the motor or to the battery 28.

When there is sufficient illumination of the solar array, the voltage produced thereby is greater than that of the battery 28. Current from the solar array flows through the diode 26 and the limiting resistor 27 to the battery 28 to recharge the battery. If the battery voltage is greater than the voltage generated by the solar array, the battery current is prevented from flowing into the solar array by the diode 26. The thermocouple 31 is a temperature controlled switch which connects the diode junction 29 to the relay 32 and thus to the motor 36. When the relay 34 is switched on, the current from the solar array bypasses the diode 26 and the limiting resistor 27, and instead flows through line 39 directly to the diode 29, through the thermocouple, and thence to the motor. If the battery voltage is greater than that of the solar array, the current from the battery flows to the thermocouple and the array is back biased. The variable resistor 33 acts as a thermostat by selectively controlling the amount of voltage generated by the thermocouple which is required to actuate the relay 32. At any time an external 12 VDC supplemental power source may be connected to the diode 37 to drive the motor 36 and to charge the battery 28.

We claim:

1. A solar powered refrigeration unit, including; an array of photovoltaic cells connected in series-parallel configuration, a trio of panel members hingably joined in a folding assembly, means for securing said photovoltaic cells to said panel members, a storage battery, diode means for connecting the positive outputs of said array and said battery, an electric motor for driving the compressor of a refrigeration unit, means for connecting both said positive outputs to said motor, including first and second diodes connected back to back, each of said positive outputs of said array and said battery connected to like terminals of respective diodes, the junction of said pair of diodes being connected to a thermocouple disposed in contact with the refrigerated enclosure, said thermocouple being connected to actuate a voltage controlled relay, said voltage controlled relay including a switched contact connected to said motor, further including thermostat means comprising a variable resistor connected between said voltage controlled relay and ground, said diode means comprising a third diode connected in series to a current limiting resistor between said positive outputs of said array and said battery, and said current limiting resistor being connected to one of said pair of diodes.

* * * * *